US005299538A

United States Patent [19]

Kennedy

[11] Patent Number: 5,299,538

[45] Date of Patent: Apr. 5, 1994

[54] INTERNAL COMBUSTION ENGINE BLOCK HAVING A CYLINDER LINER SHUNT FLOW COOLING SYSTEM AND METHOD OF COOLING SAME

[75] Inventor: Lawrence C. Kennedy, Bingham Farms, Mich.

[73] Assignee: Detroit Diesel Corporation, Detroit, Mich.

[21] Appl. No.: 57,451

[22] Filed: May 5, 1993

Related U.S. Application Data

[63] Continuation of Ser. No. 905,268, Jun. 26, 1992, abandoned.

[51] Int. Cl.[5] ..... F01P 3/20

[52] U.S. Cl. ..... 123/41.79; 123/41.84

[58] Field of Search ..... 123/41.79, 41.83, 41.84

[56] References Cited

U.S. PATENT DOCUMENTS

| | | | |
|---|---|---|---|
| 2,413,753 | 1/1947 | Dittmar | 123/173 |
| 3,363,608 | 1/1968 | Scherenbert et al. | 123/41.84 |
| 3,659,569 | 5/1972 | Mayer et al. | 123/41.79 |
| 3,714,931 | 2/1973 | Neitz et al. | 123/41.79 |
| 3,865,087 | 2/1975 | Sihon | 123/65 |
| 4,050,421 | 9/1977 | Cendak | 123/41.81 |
| 4,172,435 | 10/1979 | Schumacher | 123/41.72 |
| 4,365,593 | 12/1982 | Pomfret | 123/41.32 |
| 4,413,597 | 11/1983 | Stang et al. | 123/41.42 |
| 4,440,118 | 4/1984 | Stang et al. | 123/41.84 |
| 4,601,265 | 7/1986 | Wells et al. | 123/41.28 |
| 4,640,236 | 2/1987 | Nakano et al. | 123/41.79 |
| 4,662,321 | 5/1987 | Devaux | 123/41.79 |
| 4,794,884 | 1/1989 | Hilker et al. | 123/41.79 |
| 4,926,801 | 5/1990 | Eisenberg et al. | 123/41.840 |
| 5,086,733 | 2/1992 | Inoue et al. | 123/41.84 |

FOREIGN PATENT DOCUMENTS

| | | | |
|---|---|---|---|
| 1220202 | 6/1966 | Fed. Rep. of Germany . | |
| 2511213 | 9/1976 | Fed. Rep. of Germany . | |
| 2323020 | 4/1977 | France . | |
| 392091 | 5/1933 | United Kingdom | 123/41.84 |
| 1525766 | 9/1978 | United Kingdom . | |

OTHER PUBLICATIONS

Der Aufbau Der Raschlaufenden Verbrennungskraftmaschine by A. Scheiterlein, p. 318, Published by Wien Springer-Verlag, 1964.

*Primary Examiner*—Noah P. Kamen

*Attorney, Agent, or Firm*—Brooks & Kushman

[57] ABSTRACT

An internal combustion engine block having a circumferential channel formed between the cylinder block and a cylinder liner, surrounding and adjacent to the high temperature combustion chamber region of the engine, to which coolant flow is diverted from the main coolant stream to uniformly and effectively cool this critical area of the liner. The high velocity flow of the main coolant stream, as it passes the end of the cylinder liner adjacent the combustion chamber, provides a reduced pressure head at the port interconnecting the outlet end of the circumferential channel with the main coolant stream. Channel entrance holes, located upstream at relatively stagnant regions in the main coolant flow, are at a higher pressure head than the channel exit port, thus inducing flow through the channel at a high velocity flow.

15 Claims, 3 Drawing Sheets

INTERNAL COMBUSTION ENGINE BLOCK HAVING A CYLINDER LINER SHUNT FLOW COOLING SYSTEM AND METHOD OF COOLING SAME

This is a continuation of copending application(s) Ser. No. 07/905,268 filed on Jun. 26, 1992, now abandoned.

TECHNICAL FIELD

This invention relates to internal combustion engines and particularly to fuel injected diesel cycle engines, and specifically to the construction of the cylinder block and cylinder liner to accommodate cooling of the liner.

BACKGROUND OF THE INVENTION

It is conventional practice to provide the cylinder block of an internal combustion engine with numerous cast in place interconnected coolant passages within the area of the cylinder bore. This allows maintaining the engine block temperature at a predetermined acceptably low range, thereby precluding excessive heat distortion of the piston cylinder, and related undesirable interference between the piston assembly and the piston cylinder.

In a conventional diesel engine having replaceable cylinder liners of the flange type, coolant is not in contact with the immediate top portion of the liner, but rather is restricted to contact below the support flange in the cylinder block. This support flange is normally, of necessity, of substantial thickness. Thus, the most highly heated portion of the cylinder liner, namely the area adjacent the combustion chamber, is not directly cooled.

Furthermore, uniform cooling all around the liner is difficult to achieve near the top of the liner because location of coolant transfer holes to the cylinder head is restricted by other overriding design considerations. The number of transfer holes is usually limited, and in many engine designs the transfer holes are not uniformly spaced.

All of the foregoing has been conventional practice in internal combustion engines, and particularly with diesel cycle engines, for many, many years. However, in recent years there has been a great demand for increasing the horsepower output of the engine package and concurrently there exists redesign demands to improve emissions by lowering hydrocarbon content. Both of these demands result in hotter running engines, which in turn creates greater demands on the cooling system. The most critical area of the cylinder liner is the top piston ring reversal point, which is the top dead center position of the piston, a point at which the piston is at a dead stop or zero velocity. In commercial diesel engine operations, it is believed that this temperature at the piston reversal point must be maintained so as not to exceed 400° F. (200° C.). In meeting the demands for more power and fewer hydrocarbon emissions, the fuel injection pressure has been increased on the order of 40% (20,000 psi to about 28,000 psi) and the engine timing has been retarded. Collectively, these operating parameters make it difficult to maintain an acceptable piston cylinder liner temperature at the top piston ring reversal point with the conventional cooling technique described above.

SUMMARY OF THE INVENTION

The present invention overcomes these shortcomings by providing a continuous channel all around the liner and located near the top of the liner. Between 5 to 10% of the total engine coolant fluid flow can be directed through these channels, without the use of special coolant supply lines or long internal coolant supply passages. This diverted flow provides a uniform high velocity stream, all around and high up on the liner, to effectively cool the area of the cylinder liner adjacent to the upper piston ring travel, thus tending to better preserve the critical lubricating oil film on the liner inside surface. The resulting uniform cooling also minimizes the liner bore distortion, leading to longer service life. Further, the present invention requires but minor modification to incorporate into existing engine designs.

The present invention includes a circumferential channel formed between the cylinder block and cylinder liner, surrounding and adjacent to the high temperature combustion chamber region of an internal combustion engine, to which coolant flow is diverted from the main coolant stream to uniformly and effectively cool this critical area of the liner. Coolant flow through the channel is induced by the well known Bernoulli relationship between fluid velocity and pressure. The high velocity flow of the main coolant stream, through the passages that join the cylinder block with the cylinder head, provides a reduced pressure head at intersecting channel exit holes. Channel entrance holes, located upstream at relatively stagnant regions in the main coolant flow, are at a higher pressure head than the channel exit holes, thus inducing flow through the channel.

These and other objects of the present invention are readily apparent from the following detailed description of the best mode for carrying out the invention when taken in connection with the accompanying drawings.

BEST MODE FOR CARRYING OUT THE INVENTION

Figure 1:
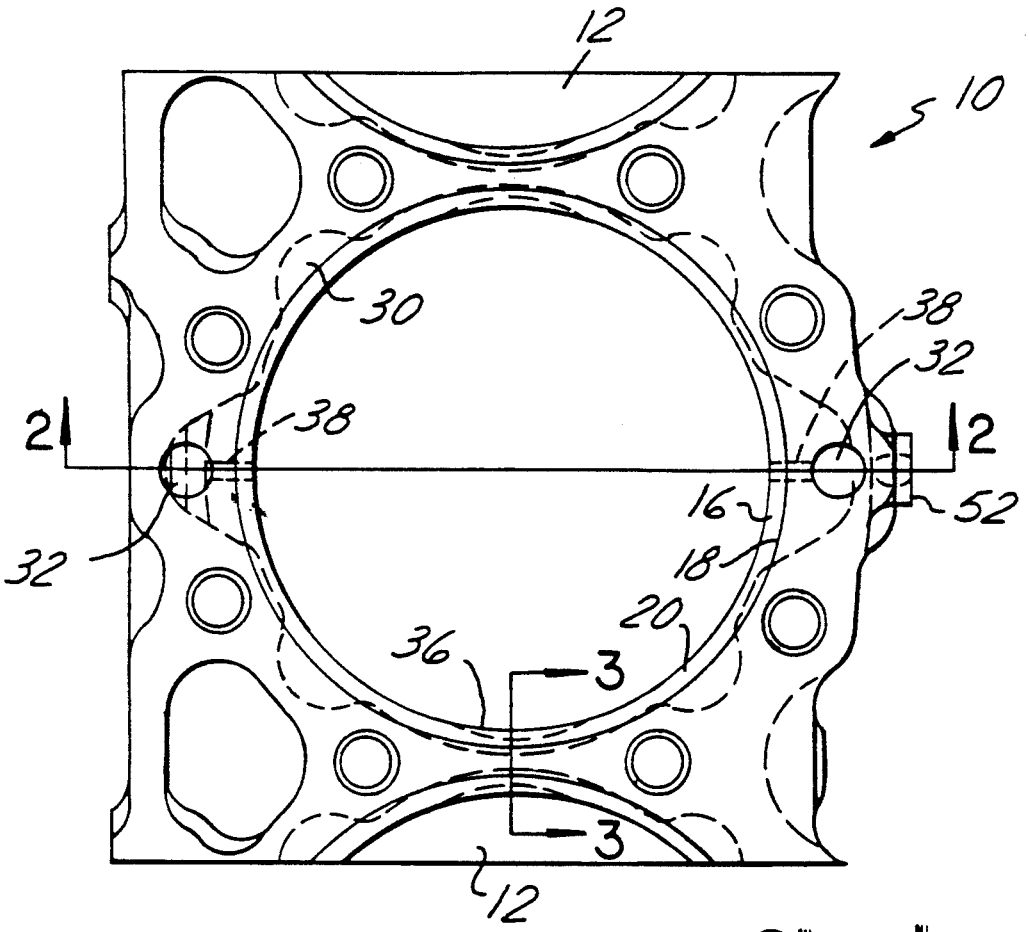
FIG. 1 is a partial plan view of the cylinder block showing a cylinder bore and partial views of adjoining cylinder bores, prior to installation of a cylinder liner, constructed in accordance with the present invention.
Figure 3:
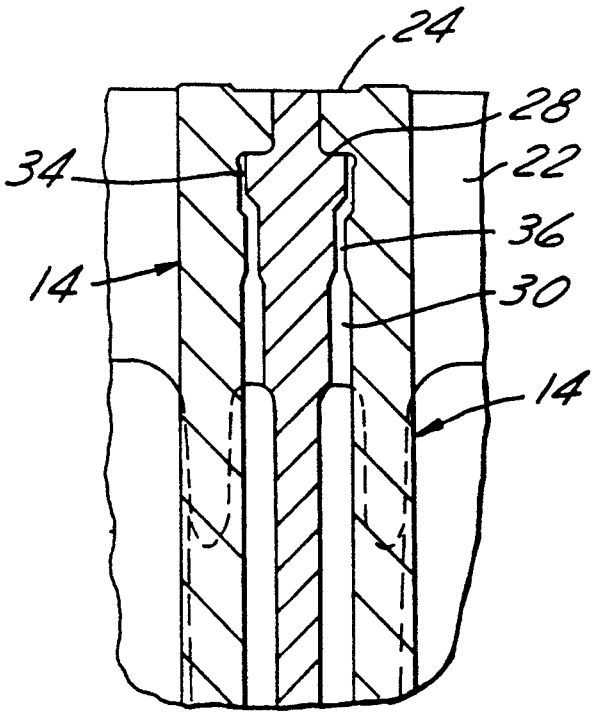
FIG. 3 is a sectional view taken substantially along the lines 3—3 of FIG. 1.
Figure 2:
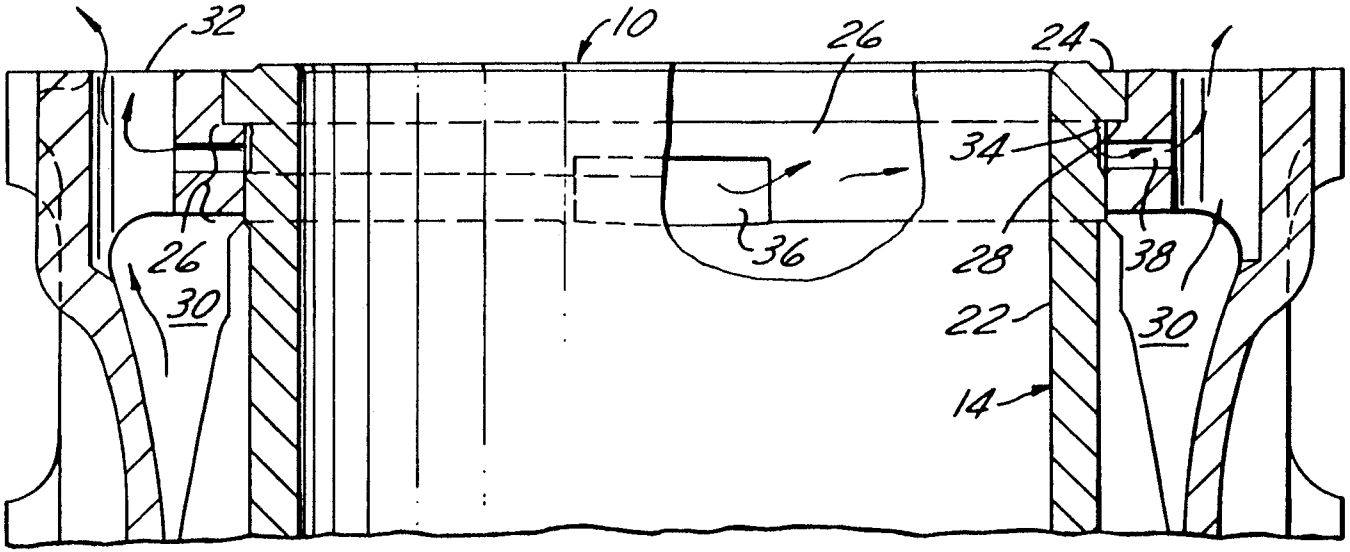
FIG. 2 is a sectional view taken substantially along the lines 2—2 of FIG. 1, but including the installation of the cylinder liner, and further showing in partial cross-section through the cylinder liner details of the coolant fluid channel inlet formed within the cylinder block in accordance with the present invention.

Pursuant to one embodiment of the present invention as show in FIGS. 1–3, a cylinder block, generally designated 10 includes a plurality of successively aligned cylinder bores 12. Each cylinder bore is constructed similarly and is adapted to receive a cylindrical cylinder liner 14. Cylinder bore 12 includes a main inner radial wall 16 of one diameter and an upper wall 18 of greater diameter so as to form a stop shoulder 20 at the juncture thereof.

Cylinder liner 14 includes a radial inner wall surface 22 of uniform diameter within which is received a reciprocating piston, having the usual piston rings, etc., as shown generally in U.S. Pat. No. 3,865,087, assigned to the same assignee as the present invention, the description of which is incorporated herein by reference.

The cylinder liner 14 further includes a radial flange 24 at its extreme one end which projects radially outwardly from the remainder of an upper engaging portion 26 of lesser diameter than the radial flange so as to form a stop shoulder 28. The entirety of the upper engaging portion 26 of the cylinder liner is dimensioned so as to be in interference fit to close fit engagement (i.e. 0.0005 to 0.0015 inch clearance) with the cylinder block, with the cylinder liner being secured in place by the cylinder head and head bolt clamp load in conventional manner.

About the cylinder liner 12, and within the adjacent walls of the cylinder block, there is provided a main coolant chamber 30 surrounding the greater portion of the cylinder liner. A coolant fluid is adapted to be circulated within the main coolant chamber from an inlet port (not shown) and thence through one or more outlet ports 32.

The general outline or boundaries of the main coolant chamber 30 are shown in phantom line in FIG. 1 as surrounding the cylinder bore, and include a pair or diametrically opposed outlet ports 32.

Thus far, the above description is of a conventionally designed internal combustion engine as shown in the above-referenced U.S. Pat. No. 3,865,087.

As further shown in FIGS. 1–3, and in accordance with the present invention, a secondary cooling chamber is provided about the uppermost region of the cylinder liner within the axial length of the upper engaging portion 26. The secondary cooling chamber is provided specifically as a circumferentially extending channel 34 machined or otherwise constructed within the radially outer wall of the upper engaging portion 26 of the cylinder liner and having an axial extent or length beginning at the stop shoulder 28 and extending approximately half-way across the upper engaging portion 26.

The secondary cooling chamber includes a pair of fluid coolant passages in the form of inlet ports 36 diametrically opposed from one another and each communicating with the main coolant chamber 30 by means of a scalloped recess constructed within the radial inner wall of the cylinder block. Each scalloped recess extends in axial length from a point opening to the main coolant chamber 30 to a point just within the axial extent or length of the channel 34, as seen clearly in FIG. 2, and each is disposed approximately 90° from the outlet ports 32.

The secondary cooling chamber also includes a plurality of outlet ports 38. The outlet ports 38 are radial passages located at and communicating with a respective one of the outlet ports 32 of the main cooling chamber. The diameter of the radially directed passage or secondary cooling chamber outlet port 38 is sized relative to that of the main coolant chamber outlet port 32 such that it is in effect a venturi.

While not shown, it is to be appreciated that the top piston ring of the piston assembly is adapted to be adjacent the secondary cooling chamber when the piston assembly is at its point of zero velocity, i.e., the top piston ring reversal point.

In terms of specific design for an internal cylinder bore diameter of 149.0 mm, the important relative fluid coolant flow parameters are as follows:

| | |
|---|---|
| Circumferential channel 34: | |
| axial length | 12.0 mm |
| depth | 1.0 mm |
| Scalloped recess (inlet port 36): | |
| radial length (depth) | 2.0 mm |
| cutter diameter for machining scallop | 3.00 inches |
| arc degrees circumscribed on cylinder bore | 20° |
| chord length on cylinder bore | 25.9 mm |
| Main cooling chamber outlet port 32: | |
| diameter | 15 mm |
| Secondary cooling chamber outlet port/venturi/radial passage 38: | |
| diameter | 6 mm |
| pressure drop across venturi/output port 38 | 0.41 psi |
| coolant flow diverted through secondary cooling chamber | 7.5% |

Generally, the above-mentioned specific parameters are selected based upon maintaining the flow area equal through the ports 36, 38 (i.e. total inlet port flow area and total outlet port flow area) and channel 34. Thus in the embodiment of FIGS. 1–3, the flow area through each inlet port 36 and outlet port 38 is twice that of the channel 34.

In operation, as coolant fluid is circulated though the main coolant chamber 30, it will exit the main coolant chamber outlet ports 32 at a relatively high fluid velocity. For example, within the main coolant chamber the fluid velocity, because of its volume relative to the outlet ports 32, would be perhaps less than one foot per second. However, at each outlet port 32 the fluid velocity may be in the order of seven to eight feet per second and would be known as an area of high fluid velocity. But for the existence of the secondary cooling chamber, the flow of coolant through the main coolant chamber would not be uniform about the entire circumference of the cylinder liner. Rather, at various points about the circumference, and in particular with respect to the embodiment shown in FIGS. 1–3 wherein there is provided two diametrically opposed outlet ports 32, a region or zone of coolant flow stagnation would form at a point approximately 90°, or half-way between, each of the outlet ports. This would create a hot spot with a potential for undesirable distortion, possible loss of lubricating oil film, leading to premature wear and blow-by.

Pursuant to the present invention, coolant fluid from the main coolant chamber is caused to be drawn through each secondary cooling chamber inlet port 36 as provided by the scalloped recess and thence to be split in equal flow paths to each of the respective outlet ports 38, thence through the venturi, i.e. the radial passage forming the outlet port 38, and out the main cooling chamber outlet ports 32. By reason of the Bernoulli relationship between the fluid velocity and pressure, the high velocity flow of the main coolant stream through each outlet port 32 provides a reduced pressure head at the intersection with the venturi or radial passage 38. Thus the coolant within the secondary cooling chamber or channel 34 will be at a substantially higher pressure head than that which exists within the radial passages 38, thereby inducing flow at a relatively high flow rate through the channel 34. In practice, it has been found that the fluid velocity through the secondary channel 34 will be, in the example given above, at about three, and perhaps as much as six feet per second. This, therefore, provides a very efficient means for removing a significant portion of the thermal energy per unit area of the cylinder liner at the uppermost region of the cylinder liner adjacent the combustion chamber.

As an alternative to the scalloped recess forming inlet port 36 being constructed within the inner radial wall of the cylinder bore, the cylinder liner may be constructed with a flat chordal area 36 as shown in FIG. 3c of the same dimension (i.e. same axial length and circumferential or chord length) and within the same relative location of the above-described recess. The effect is the same, namely providing a channel communicating the coolant flow from the main coolant chamber 30 with that of the secondary cooling chamber channel 34.

Figure 4:
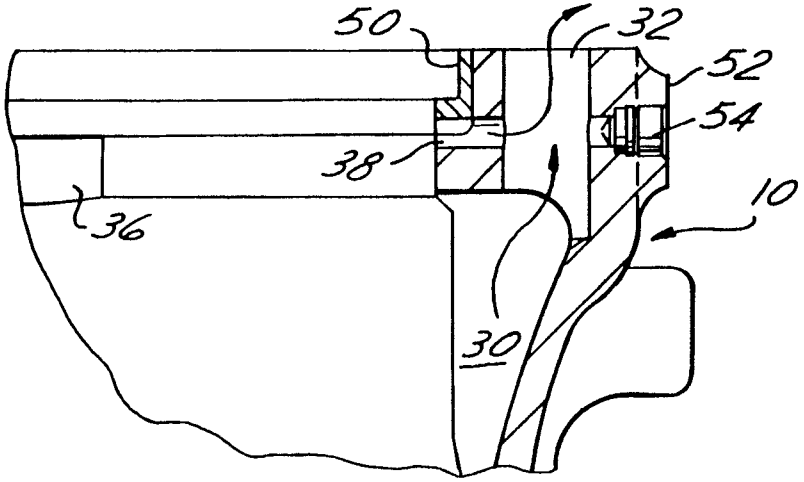
FIG. 4 is a partial cross-sectional view similar to FIG. 2 and showing an alternative embodiment of the present invention wherein the cylinder bore is provided with a repair bushing.
Figure 3A:
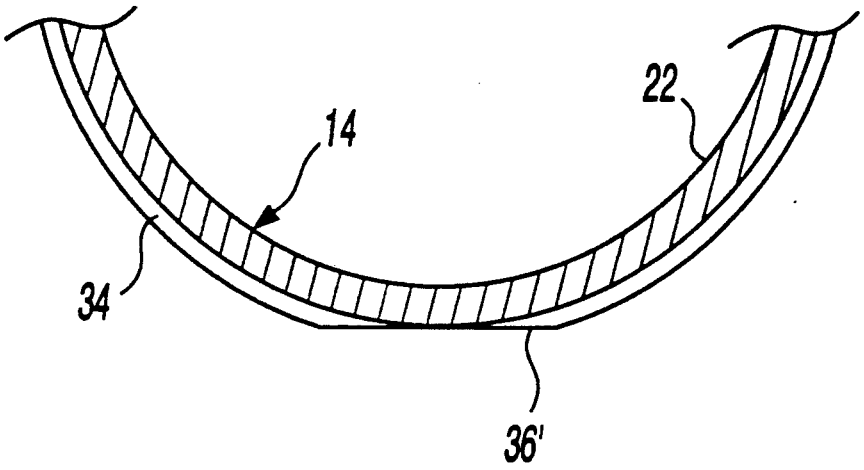
FIG. 3*a* is an alternative embodiment whrerein the inlet port to the secondary cooling chamber is provided within the liner rather than cylinder block.

In FIG. 4, there is shown an alterative embodiment of the present invention, particularly applicable for remanufactured cylinder blocks, whereby the cylinder bore includes a repair bushing 50 press fit within the cylinder block 10 and including the same stop shoulder 20 for receiving the cylinder liner. Likewise, the repair bushing and cylinder liner include a pair of radial passages extending therethrough to provide outlet ports 38 and thereby establishing coolant fluid flow between the secondary cooling chamber and the main outlet ports 32. Also as seen in FIG. 4, the radial extending passage of outlet port 38 is easily machined within the cylinder block by drilling in from the boss 52 and thereafter plugging the boss with a suitable machining plug 54.

The foregoing description is of a preferred embodiment of the present invention and is not to be read as limiting the invention. The scope of the invention should be construed by reference to the following claims.

What is claimed is:

1. In combination, in an internal combustion engine, a cylinder block, having at least one cylinder bore;

a cylinder inner concentrically located within said cylinder bore and secured to said cylinder block;

a main cooling chamber surrounding said cylinder liner and having an inlet port and at least one outlet port for circulating a coolant fluid about a main portion of said cylinder liner;

a secondary cooling chamber located about the uppermost portion of said cylinder liner and directly adjacent to said main coolant passage, said secondary cooling chamber having at least one inlet port and at least one output port whereby said fluid coolant may be circulated simultaneously about said main cooling chamber and said secondary coolant chamber;

said outlet port of said secondary cooling chamber being in fluid communication with the outlet port of said main cooling chamber and comprising a venturi whereby, as coolant from the main cooling chamber flows through the outlet port of said main cooling chamber, there will be created across said venturi a pressure drop which in turn will induce the flow of coolant fluid through said secondary cooling chamber at a flow velocity relative to that flowing through said outlet port sufficient to provide a significantly increased rate of removal of thermal energy per unit area of said cylinder inner at the uppermost portion of said cylinder liner.

2. The invention of claim 1 wherein said inlet port of said secondary cooing chamber is radially positioned about the circumference of said secondary cooling chamber such that the incoming coolant fluid to said inlet port is divided into two flow paths of substantially equal flow velocity extending in opposite directions and exiting through said at least one outlet port of said main cooling passage.

3. In combination, in an internal combustion engine, a cylinder block, having at least one cylinder bore;

a cylinder liner concentrically located within said cylinder bore and secured to said cylinder block;

a main cooling passage surrounding said cylinder liner and having an inlet port and outlet port for circulating a coolant fluid about a main portion of said cylinder liner;

a secondary cooling chamber interconnected with said main cooling chamber and being concentrically located about the uppermost portion of said cylinder liner and directly adjacent to said main coolant passage, said secondary cooling chamber having an inlet port and an outlet port whereby said fluid coolant may be circulated simultaneously about said main cooling chamber and said secondary coolant chamber, said inlet port of said secondary coolant chamber being in open fluid communication with said main cooling chamber;

said outlet port of said secondary cooling chamber being in fluid communication with the outlet port of said main cooling chamber and comprising a venturi whereby, as coolant from the main cooling chamber flows through the outlet port of said main cooling chamber, there will be created across said venturi a pressure drop, thereby inducing the flow of coolant fluid through said secondary cooling chamber at a significantly higher flow velocity than that flowing through said main cooling chamber, thus allowing a significantly increased rate of removal of thermal energy per unit area of said cylinder liner at the uppermost portion of said cylinder liner.

4. The invention of claim 3 wherein said cylinder block and cylinder liner include in combination a pair of said inlet ports communicating with said secondary cooling chamber and diametrically opposed from one another and a pair of said main cooling chamber outlet ports and equally radially spaced from said secondary cooling chamber inlet ports, whereby the coolant fluid incoming to said secondary cooling chamber is divided into two flow paths of substantially equal flow velocity extending in opposite circumferential direction and exiting through a respective one of said secondary cooling chamber outlet ports.

5. The invention of claim 4 wherein said cylinder block bore includes a counter bore at the upper end adjacent the combustion chamber and thereby providing an annular shoulder, said cylinder liner being supported on said shoulder, said secondary cooling chamber comprising a channel constructed within the outer wall of said cylinder liner substantially just below said shoulder and circumferentially about said outer wall, said shoulder defining a seal for precluding the egress of coolant fluid from said channel.

6. The invention of claim 5 wherein each said secondary cooling chamber outlet port comprises a radial passage extending through said cylinder block at a point just below said shoulder and communicating with said main cooling chamber outlet port.

7. The invention of claim 3 wherein said cylinder head bore includes a counter bore at the upper end adjacent the combustion chamber and thereby providing an annular shoulder, said cylinder liner being supported on said shoulder, said secondary cooling chamber comprising a channel constructed within the outer wall of said cylinder liner substantially just below said shoulder and extending circumferentially about said outer wall, said shoulder defining a seal for precluding the egress of coolant fluid from said channel.

8. The invention of claim 7 wherein there are two of said outlet ports said outlet ports for said secondary cooling chamber each comprise a radial port extending through said cylinder head at a point just below said shoulder and communicating with a respective one of said main cooling chamber outlet ports.

9. The invention of claim 7 wherein said secondary cooling chamber inlet port comprises a recess constructed within the inner radial wall of the cylinder block defining said cylinder bore, said recess being open to said main cooling chamber and in open communication with said circumferential channel.

10. The invention of claim 3 wherein said cylinder head and cylinder liner include in combination a pair of said inlet ports and a pair of said outlet ports, each said pair of ports communicating with said secondary cooling chamber and each port in said pair of ports being diametrically opposed from the other port of said pair of ports, said cylinder block including a pair of said main cooling chamber outlet ports, each said main cooling chamber outlet port being in fluid communication with a respective one of said secondary cooling chamber outlet ports, and the flow area across each of said inlet ports and outlet ports of said secondary cooling chamber being equal to one another and being twice the flow area across the remainder of said secondary cooling chamber, whereby the coolant fluid incoming to said secondary cooling chamber is divided into two equal flow paths of substantially equal flow velocity extending in opposite circumferential direction and exiting through a respective one of said secondary cooling chamber outlet ports.

11. A cylinder liner for an internal combustion engine to be secured within a cylinder block having a cylinder bore for receiving the cylinder liner;

said cylinder inner including a radial flange at the one end thereof to be adjacent the combustion chamber of the engine, and a cylinder block engagement portion immediately therebelow said radial flange including a circumferentially extending stop shoulder at the junction of said radial flange with said cylinder block engagement portion, whereby said cylinder inner may be supported and held within the cylinder block throughout the axial extend of said radial flange and said cylinder block engagement portion, and a channel means within said cylinder block engagement portion and extending about the circumference of said liner for providing a cooling chamber within which a fluid coolant may be circulated maintaining said one end of the cylinder liner at a substantially uniform temperature;

said channel means extending in axial length from said stop shoulder to a point substantially one-half the axial length of said cylinder block engagement portion.

12. The invention of claim 11 wherein cylinder liner includes a fluid coolant passage means extending the axial length of said cylinder block engagement portion and open to said channel means whereby a fluid coolant may be circulated through said passage means to said channel means.

13. The invention of claim 12 wherein said fluid coolant passage means is constructed as a flat surface on the outer cylindrical wall surface of said cylinder block engagement portion.

14. A method of cooling a cylinder liner within the cylinder block of an internal combustion engine comprising:

providing a cylinder liner concentrically located within said cylinder bore and secured to said cylinder block;

providing a main coolant chamber surrounding said cylinder liner and having an inlet port and outlet port for circulating a coolant fluid about a main portion of said cylinder liner;

providing a secondary cooling chamber concentrically located about the uppermost portion of said cylinder liner and directly adjacent to said main coolant passage, said secondary cooling chamber being provided with an inlet port and an outlet port whereby said fluid coolant may be circulated simultaneously about said main coolant chamber and said secondary coolant chamber;

said outlet port of said secondary coolant chamber being in fluid communication with the outlet port of said main coolant chamber and comprising a venturi whereby, as coolant from the main cooling chamber flows through the outlet port of said main cooling chamber, there will be created across said venturi a pressure drop which in turn will induce the flow of coolant fluid through said secondary cooling chamber at a flow velocity of substantially magnitude relative to that flowing through said outlet port, thereby providing a significantly increased rate of removal of thermal energy per unit area of said cylinder liner at the uppermost portion of said cylinder liner.

15. The method of claim 14 further including the step of directly about 5–10% of the total engine coolant fluid flow from said main coolant passage to said secondary cooling chamber.

* * * * *

UNITED STATES PATENT AND TRADEMARK OFFICE

CERTIFICATE OF CORRECTION

PATENT NO. : 5,299,538

DATED : April 5, 1994

INVENTOR(S) : Lawrence C. Kennedy

It is certified that error appears in the above-indentified patent and that said Letters Patent is hereby corrected as shown below:

Col. 2, line 64, delete "show" and insert --shown--.

Col. 5, line 15, after "area" delete "36" and insert --36'--.

Col. 5, line 15, after "Figure" delete "3c" and insert --3a--.

Col. 5, line 44, claim 1, after "cylinder" delete "inner" and insert --liner--.

Col. 6, lin e 1, claim 1, after "cylinder" delete "inner" and insert --liner--.

Col. 6, line 4, claim 2, after "secondary" delete "cooing" and insert --cooling--.

Col. 7, line 48, claim 11, after "cylinder" delete "inner" and insert --liner--.

Col. 7, line 55, claim 11, after "cylinder" delete "inner" and insert --liner--.

UNITED STATES PATENT AND TRADEMARK OFFICE

CERTIFICATE OF CORRECTION

PATENT NO. : 5,299,538

DATED : April 5, 1994

INVENTOR(S) : Lawrence C. Kennedy

It is certified that error appears in the above-indentified patent and that said Letters Patent is hereby corrected as shown below:

Col. 8, line 47, claim 14, after "velocity of" delete "substantially" and insert --substantial--.

Signed and Sealed this

Twenty-seventh Day of September, 1994

*Attest:*

Bruce Lehman

BRUCE LEHMAN

*Attesting Officer*

*Commissioner of Patents and Trademarks*